US005427704A

United States Patent [19]

Lawate

[11] Patent Number: 5,427,704

[45] Date of Patent: Jun. 27, 1995

[54] TRIGLYCERIDE OILS THICKENED WITH ESTOLIDES OF HYDROXY-CONTAINING TRIGLYCERIDES

[75] Inventor: Saurabh S. Lawate, Concord, Ohio

[73] Assignee: The Lubrizol Corporation, Wickliffe, Ohio

[21] Appl. No.: 187,889

[22] Filed: Jan. 28, 1994

[51] Int. Cl.[6] ..... C10M 129/78

[52] U.S. Cl. ..... 252/56 R; 252/56.5

[58] Field of Search ..... 252/56 S, 56 R

[56] References Cited

U.S. PATENT DOCUMENTS

| | | | |
|---|---|---|---|
| 844,426 | 2/1907 | Twitchell . | |
| 2,049,072 | 7/1936 | Mikeska et al. | 87/9 |
| 2,156,737 | 5/1939 | Priester | 260/413 |
| 2,652,410 | 9/1953 | Cunnigham et al. | 260/404.5 |
| 2,652,411 | 9/1953 | Teeter et al. | 260/405 |
| 2,877,181 | 3/1959 | Dilworth et al. | 252/40.5 |
| 3,720,695 | 3/1973 | Meisters | 260/404.8 |
| 3,909,425 | 9/1975 | Crawford et al. | 252/32.7 |
| 4,108,785 | 8/1978 | Sturwold | 252/56 R |
| 4,582,715 | 4/1986 | Volpenhein | 426/601 |
| 4,769,178 | 9/1988 | Kenmochi et al. | 252/56 |
| 4,885,104 | 12/1989 | Sturwold | 252/56 S |
| 4,978,465 | 12/1990 | Sturwold | 252/56 S |
| 5,037,564 | 8/1991 | Nishizaki et al. | 252/22 |
| 5,145,593 | 9/1992 | Takashima | 252/56 |
| 5,151,205 | 9/1992 | Culpon, Jr. | 252/51.5 |
| 5,298,177 | 3/1994 | Stoffa | 252/56 R |

*Primary Examiner*—Jacqueline V. Howard
*Attorney, Agent, or Firm*—James L. Cordek; Frederick D. Hunter; Joseph P. Fischer

[57] ABSTRACT

A thickened composition is disclosed which comprises (A) at least one triglyceride estolide of the formula

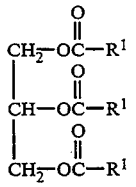

wherein $R^1$ is an aliphatic group or an aliphatic group containing an ester moiety $R^2COO$— with the proviso that at least one $R^1$ is an aliphatic group containing the ester moiety, and contains from about 5 to about 23 carbon atoms, and $R^2$ is a hydrocarbyl group containing from 1 to 100 carbon atoms and (B) at least one animal fat, vegetable oil or synthetic triglyceride oil of the formula

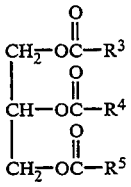

wherein $R^3$, $R^4$ and $R^5$ are aliphatic groups or hydroxy containing aliphatic groups that are at least 60 percent monounsaturated, and further wherein an oleic acid moiety:linoleic acid moiety ratio is from about 2 up to about 90, and contain from about 1 to about 23 carbon atoms.

29 Claims, No Drawings

TRIGLYCERIDE OILS THICKENED WITH ESTOLIDES OF HYDROXY-CONTAINING TRIGLYCERIDES

FIELD OF THE INVENTION

The present invention relates to the thickening of triglyceride oils by dissolving therein an estolide of a hydroxy-containing triglyceride. In another embodiment the triglyceride oil is thickened through an interesterification reaction by reacting the triglyceride oil with an estolide of a hydroxy-containing triglyceride in the presence of a catalyst.

BACKGROUND OF THE INVENTION

Successful use of triglyceride oils as environmentally friendly, that is biodegradable, base fluids in industrial applications and also as a fuel additive when mixed with normally liquid fuels, is contingent upon increasing the viscosity of the triglyceride. In many industrial applications the triglyceride is too thin to be of value. In order to take advantage of the biodegradability of triglyceride oils, it becomes necessary to increase their viscosity.

U.S. Pat. No. 844,426 (Twitchell, Feb. 19, 1907) relates to a process for manufacturing certain organic products. One of the reactants contains an alcoholic hydroxyl, of which castor oil is cited, and the other reactant is a fatty acid such as stearic and oleic acids. The reaction takes place in the presence of a catalyst described as containing a sulfa fatty acid group.

U.S. Pat. No. 2,156,737 (Priester, May 2, 1939) relates to the preparation or production of unsaturated fatty acids of the type containing two double bonds and to the preparation of an intermediate product from which said unsaturated fatty acids may be derived.

More particularly stated, this reference relates to a process for the preparation of 9,11-octadecadiene 1-acid from ricinoleic acid. The ricinoleic acid is both pure ricinoleic acid or ricinoleic acid obtained from castor oil of which the latter being obtained by the splitting up of castor oil.

U.S. Pat. No. 2,049,072 (Mikeska et al, Jul. 28, 1936) relates to the preparation of lubricants by blending with a mineral oil the product obtained by esterification of hydroxy groups in natural or synthetic fatty acids or glycerides, with special reference to castor oil, with or without subsequent stabilizations of said esterified product as by hydrogenation.

U.S. Pat. No. 2,652,410 (Cunningham et al, Sep. 15, 1953) relates to methods for reacting alpha-hydroxy acids and/or estolides with polyhydric alcohols. More particularly, this reference relates to methods for esterifying and dehydroxylating alpha-hydroxy acids and/or estolides such as are obtained by the controlled oxidation of paraffin wax.

U.S. Pat. No. 2,877,181 (Dilworth et al, Mar. 10, 1959) relates to anhydrous calcium fatty acid greases. More particularly, this reference discloses an additive that stabilizes anhydrous calcium fatty acid greases. This additive is an estolide and the estolides which act as stabilizers are intermolecular esters and polyesters of $C_{10}$ to $C_{24}$ hydroxy fatty acids having the general formula

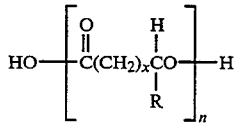

wherein R is an aliphatic hydrocarbon radical containing 1 to 21 carbon atoms, x is an integer having a value to 1 to 21 and n is an integer having a value of 2 to about 12.

U.S. Pat. No. 4,582,715 (Volpenhein, Apr. 15, 1986) relates to alpha acrylated glycerides of the formula:

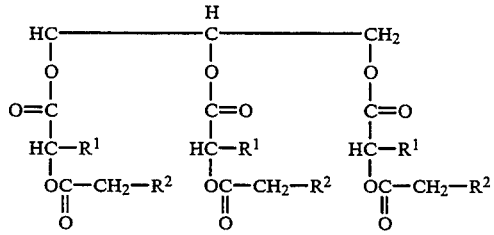

wherein each $R^1$ is a $C_{10}$-$C_{14}$ alkyl group and wherein each $R^2$ is a $C_{14}$-$C_{16}$ aliphatic group.

SUMMARY OF THE INVENTION

A composition is disclosed which comprises (A) at least one triglyceride estolide of the formula

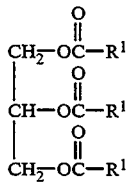

wherein $R^1$ is an aliphatic group or an aliphatic group containing an ester moiety $R_2COO$— with the proviso that at least one $R^1$ is an aliphatic group containing the ester moiety, and contains from about 5 to about 23 carbon atoms, and $R^2$ is a hydrocarbyl group containing from 1 to 100 carbon atoms and (B) at least one animal fat, vegetable oil or synthetic triglyceride oil of the formula

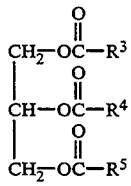

wherein $R^3$, $R^4$ and $R^5$ are aliphatic groups or hydroxy containing aliphatic groups that are saturated, monounsaturated, polyunsaturated or mixtures thereof, and contain from about 1 to about 23 carbon atoms.

DETAILED DESCRIPTION OF THE INVENTION (A) The Triglyceride Estolide

An estolide is the product formed by the esterification reaction of a hydroxy-containing fatty acid and a carboxylic acid.

The esterification to form the estolide occurs at a temperature of from ambient up to the decomposition temperature of any reactant or product. Usually the upper temperature limit is not more than 150° C. and preferably not more than 120° C. To shift the equilibrium to the right when forming an estolide, it is necessary to use either a large excess of carboxylic acid, or else remove water as it is formed. In either case, excess carboxylic acid or formed water can be removed by distillation.

As an example, under proper conditions the —OH from one ricinoleic acid molecule can react with the —COOH of another ricinoleic acid molecule to give an estolide:

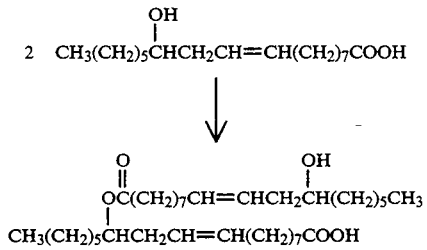

This estolide would continue to crosslink or react linearly at the unreacted —OH and —COOH sites to form a polyestolide.

In this invention, component (A) is a triglyceride estolide of the formula

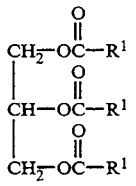

wherein $R^1$ is an aliphatic group or an aliphatic group containing an ester moiety $R^2COO$— with the proviso that at least one $R^1$ is an aliphatic group containing the ester moiety, and contains from about 5 to about 23 carbon atoms, and $R^2$ is a hydrocarbyl group containing from 1 to 100 carbon atoms.

The aliphatic group $R^1$ is alkyl such as pentyl, heptyl, nonyl, undecyl, tridecyl, heptadecyl; alkenyl containing a single bond such as heptenyl, nonenyl, undecenyl, tridecenyl, heptadecenyl, nonadecenyl, heneicosenyl; alkenyl containing 2 or 3 double bonds such as 8,11-heptadecadienyl and 8,11,14-heptadecatrienyl. All isomers of these are included, but straight chain groups are preferred.

At least one of the $R^1$ groups contains the ester moiety $R^2COO$—. The residue of this $R^1$ group (the $R^1$ as described above less the hydrogen and also less the $R^2COO$—) is still defined as an aliphatic group and as such is defined by the parameters of the aliphatic groups above. An example of an $R^1$ containing the ester moiety is

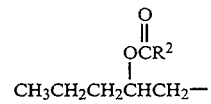

Removing the $R^2COO$— from this structure gives

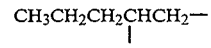

a residue which is defined as an aliphatic group.

The hydrocarbyl group $R^2$ includes the following:

(1) Aliphatic hydrocarbon groups; that is, alkyl groups such as heptyl, nonyl, undecyl, tridecyl, heptadecyl; alkenyl groups containing a single double bond such as heptenyl, nonenyl, undecenyl, tridecenyl, isostearyi, heptadecenyl, heneicosenyl; alkenyl groups containing 2 or 3 double bonds such as 8,11-heptadecadienyl and 8,11,14-heptadecatrienyl. All isomers of these are included, but straight chain groups are preferred.

(2) Substituted aliphatic hydrocarbon groups; that is groups containing non-hydrocarbon substituents which, in the context of this invention, do not alter the predominantly hydrocarbon character of the group. Those skilled in the art will be aware of suitable substituents; examples are hydroxy, carbalkoxy, (especially lower carbalkoxy) and alkoxy (especially lower alkoxy), the term, "lower" denoting groups containing not more than 7 carbon atoms.

(3) Hetero groups; that is, groups which, while having predominantly aliphatic hydrocarbon character within the context of this invention, contain atoms other than carbon present in a chain or ring otherwise composed of aliphatic carbon atoms. Suitable hetero atoms will be apparent to those skilled in the art and include, for example, oxygen, nitrogen and sulfur.

At least one of the $R^1$ groups is an aliphatic group containing an ester moiety $R^2COO$—. In a preferred embodiment $R^1$ is

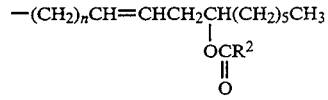

wherein n is from 5 to 13 and $R^2$ is an aliphatic group containing 1 to 23 carbon atoms, preferably from 4 to 18 carbon atoms.

The triglyceride estolide (A) is prepared by reacting a triglyceride that contains at least one —OH group with a carboxylic acid $R^2COOH$. At least 1 up to 3 —OH groups are present in the triglyceride. For each —OH group present, there is employed one mole of carboxylic acid.

Triglycerides containing —OH groups occur in nature as castor oil wherein n is 7 and contains three —OH groups and lesquerella oil wherein n is 9 and contains two —OH groups.

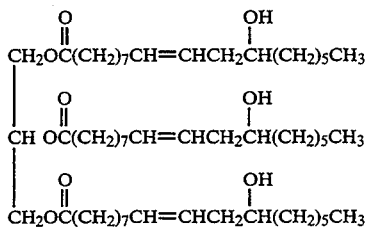

CASTOR OIL

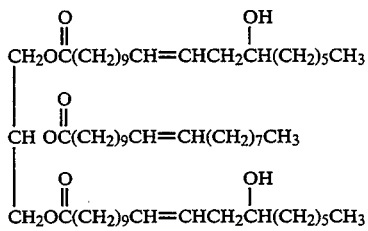

LESQUERELLA OIL

The chemical profiles of castor oil and lesquerella oil show triglycerides other than those of the structures outlined above. A triglyceride of ricinoleic acid is the predominate triglyceride of castor oil and is present at from 80–89% by weight. A triglyceride of 2 moles 14-hydroxy-11-eicosenoic acid and 1 mole 11-eicosenoic acid is the predominate triglyceride of lesquerella oil and is generally present in lesquerella oil in an amount in excess of 50% by weight.

The carboxylic acid $R^2COOH$ reacted with the hydroxy-containing triglyceride contains from 2 to 24 carbon atoms (acetic acid to tetracosanoic acid) including isomers and unsaturation. Preferred carboxylic acids are the acids of butyric, caproic, caprylic, capric, lauric, myristic, palmitic, stearic, oleic, linoleic, and linolenic.

The esterification to make the triglyceride estolide occurs by reacting a carboxylic acid with the hydroxy containing triglyceride. One mole of carboxylic acid is employed for every —OH group present in the hydroxy-containing triglyceride.

The following examples are illustrative of the preparation of triglyceride estolides wherein the carboxylic acid is a monocarboxylic acid. Unless otherwise indicated, all parts and percentages are by weight. Solvents may or may not be employed. Optimally, the obtained estolides are refined and bleached.

Example A-1

Added to a 1 liter, 4 neck flask are 200 parts (0.19 moles) of castor oil, 74.2 parts (0.57 moles) heptanoic acid, 300 ml xylene and 2.5 parts paratoluenesulfonic acid. The contents are heated to 150° C. with stirring during which time water is azeotroped off. Xylene is stripped off using a nitrogen sweep and later to 12 millimeters mercury. The contents are filtered to give the desired product.

Example A-2

Lesquerella oil and heptanoic acid are reacted on a (1 —OH:1 —COOH) basis. The lesquerella oil, heptanoic acid, para-toluenesulfonic acid and xylene are added to a flask and the procedure of Example A-1 is essentially followed. The filtrate is the desired product.

Example A-3

Lesquerella oil and isostearic acid are reacted on a (1 —OH:1 —COOH) basis. The lesquerella oil, isostearic acid, xylene and methanesulfonic acid are added to a flask and the procedure of Example A-1 is essentially followed. The filtrate is the desired product.

Example A-4

Lesquerella oil and oleic acid are reacted on a (1 —OH:1 —COOH) basis. The lesquerella oil, oleic acid, xylene and methanesulfonic acid are added to a flask and the procedure of Example A-1 is essentially followed. The filtrate is the desired product.

Mono carboxylic acids are also formed by the hydrolysis of a triglyceride.

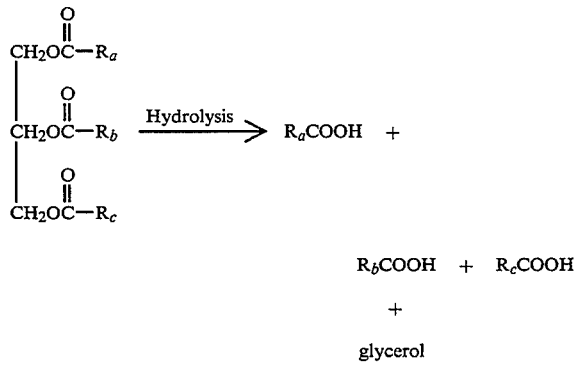

In the above reactions $R_a$, $R_b$ and $R_c$ are the same or different and contain from 1 to 23 carbon atoms.

The following example is directed to the preparation of a triglyceride estolide wherein the monocarboxylic acid is obtained from the hydrolysis of a triglyceride.

Example A-5

Added to a 12 liter, 4 neck flask are 3129 parts Sunyl 87, 3000 parts water and 1000 parts isopropyl alcohol. The mixture is heated to 60° C. and added is 100 parts of a 50% aqueous solution of sodium hydroxide. The sodium hydroxide solution is added in 50 millimeter portions. This addition is exothermic and cooling is required to keep the reaction under control. At the end of this addition, the contents are permitted to continue stirring for 6 hours. At 60° C. concentrated aqueous hydrochloric acid (37%) is slowly added until a pH of 2 is reached. At the end of this addition, the contents are permitted to stir for 30 more minutes. Stirring is halted and the contents separate into layers. The bottom (aqueous) portion is removed and discarded and the remainder of the contents is washed three times with 1000 parts hot water. After the third wash, the water layer is removed and discarded and the contents are stripped and filtered to give a monocarboxylic acid mixture containing 87% oleic acid.

In a separate flask are added lesquerella oil and the 87% oleic acid on a 1 —OH:1 —COOH basis, along with para-toluenesulfonic acid and xylene. The contents are heated to 150° C. with stirring while azeotroping off water. The contents are then stripped and filtered to give the desired product.

(B) The Triglyceride Oil

Component (B) of this invention is a triglyceride oil which is a natural or synthetic oil of the formula

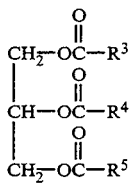

wherein $R^3$, $R^4$ and $R^5$ are aliphatic hydrocarbyl groups containing from about 1 to about 23 carbon atoms.

The term "hydrocarbyl group" as used herein denotes a radical having a carbon atom directly attached to the remainder of the molecule. The aliphatic hydrocarbyl groups include the following:

(1) Aliphatic hydrocarbon groups; that is, alkyl groups such as heptyl, nonyl, undecyl, tridecyl, heptadecyl, nonadecenyl; alkenyl groups containing a single double bond such as heptenyl, nonenyl, undecenyl, tridecenyl, heptadecenyl, heneicosenyl; alkenyl groups containing 2 or 3 double bonds such as 8,11-heptadecadienyl and 8,11,14-heptadecatrienyl. All isomers of these are included, but straight chain groups are preferred.

(2) Substituted aliphatic hydrocarbon groups; that is groups containing non-hydrocarbon substituents which, in the context of this invention, do not alter the predominantly hydrocarbon character of the group. Those skilled in the art will be aware of suitable substituents; examples are hydroxy, carbalkoxy, (especially lower carbalkoxy) and alkoxy (especially lower alkoxy), the term, "lower" denoting groups containing not more than 7 carbon atoms.

(3) Hetero groups; that is, groups which, while having predominantly aliphatic hydrocarbon character within the context of this invention, contain atoms other than carbon present in a chain or ring otherwise composed of aliphatic carbon atoms. Suitable hetero atoms will be apparent to those skilled in the art and include, for example, oxygen, nitrogen and sulfur.

Naturally occurring triglycerides are animal fat triglycerides and vegetable oil triglycerides. The synthetic triglycerides are those formed by the reaction of one mole of glycerol with three moles of a fatty acid or mixture of fatty acids. Preferred are vegetable oil triglycerides.

The groups $R^3$, $R^4$ and $R^5$ may have an unsaturation content as low as 7–11 percent for coconut oil and as high as 100% for a synthetic triglyceride of glycerol and oleic acid. Generally the fatty acid moieties are such that the triglyceride has a monounsaturated character of at least 60 percent, preferably at least 70 percent and most preferably at least 80 percent. Normal sunflower oil has an oleic acid content of 25–30 percent. By genetically modifying the seeds of sunflowers, a sunflower oil can be obtained wherein the oleic content is from about 60 percent up to about 90 percent. U.S. Pat. Nos. 4,627,192 and 4,743,402 are herein incorporated by reference for their disclosures directed to the preparation of high oleic sunflower oil. For example, a triglyceride comprised exclusively of an oleic acid moiety has an oleic acid content of 100% and consequently a monounsaturated content of 100%. Where the triglyceride is made up of acid moieties that are 70% oleic acid, 10% stearic acid, 5% palmitic acid, 7% linoleic and 8% hexadecenoic acid, the monounsaturated content is 78%.

Naturally occurring triglycerides having utility in this invention are exemplified by vegetable oils that are genetically modified such that they contain a higher than normal oleic acid content. That is, the $R^1$, $R^2$ and $R^3$ groups are heptadecenyl groups and the $R^1COO^-$, $R^2COO^-$ and $R^3COO^-$ that are attached to the 1,2,3,-propanetriyl groups —$CH_2CHCH_2$13 are the residue of an oleic acid molecule. Generally the fatty acid moieties are such that the triglyceride has monounsaturated character of at least 60 percent, preferably 80 percent. Normal sunflower oil has an oleic acid content of 20–40 percent. By genetically modifying the seeds of sunflowers, a sunflower oil can be obtained wherein the oleic content is from about 60 percent up to about 90 percent. U.S. Pat. No. 4,627,192 and 4,743,402 are herein incorporated by reference for their disclosures directed to the preparation of high oleic sunflower oil. The preferred triglyceride oils are genetically modified high oleic (at least 60 percent) acid triglyceride oils. Typical genetically modified high oleic vegetable oils employed within the instant invention are high oleic safflower oil, high oleic corn oil, high oleic rapeseed oil, high oleic sunflower oil, high oleic soybean oil, high oleic cottonseed oil, high oleic lesquerella oil, high oleic meadowfoam oil and high oleic palm olein. A preferred high oleic vegetable oil is high oleic sunflower oil obtained from Helianthus sp. This product is available from SVO Enterprises, Eastlake, Ohio as Sunyl$^R$high oleic sunflower oil. Sunyl 80 is a high oleic triglyceride wherein the acid moieties comprise 80 percent oleic acid. Another preferred high oleic vegetable oil is high oleic rapeseed oil obtained from Brassica campestris or Brassica napus, also available from SVO Enterprises as RS$^R$ high oleic rapeseed oil. RS 80 signifies a rapeseed oil wherein the acid moieties comprise 80 percent oleic acid.

It is to be noted the olive oil is excluded as a vegetable oil in this invention. The oleic acid content of olive oil typically ranges from 65–85 percent. This content, however, is not achieved through genetic modification, but rather is naturally occurring.

It is further to be noted that genetically modified vegetable oils have high oleic acid contents at the expense of the di- and tri- unsaturated acids. A normal sunflower oil has from 20–40 percent oleic acid moieties and from 50–70 percent linoleic acid moieties. This gives a 90 percent content of mono- and di- unsaturated acid moieties (20+70 or 40+50). Genetically modifying vegetable oils generate a low di- or tri- unsaturated moiety vegetable oil. The genetically modified oils of this invention have an oleic acid moiety:linoleic acid moiety ratio of from about 2 up to about 90. A 60 percent oleic acid moiety content and 30 percent linoleic acid moiety content of a triglyceride oil gives a ratio of 2. A triglyceride oil made up of an 80 percent oleic acid moiety and 10 percent linoleic acid moiety gives a ratio of 8. A triglyceride oil made up of a 90 percent oleic acid moiety and 1 percent linoleic acid moiety gives a ratio of 90. The ratio for normal sunflower oil is 0.5 (30 percent oleic acid moiety and 60 percent linoleic acid moiety).

Non-genetically modified vegetable oils having utility in this invention are sunflower oil, safflower oil, corn oil, soybean oil, rapeseed oil, meadowfoam oil, lesquerella oil or castor oil.

This first embodiment comprises an admixture of components (A) and (B). Typically the weight ratio of (A):(B) is from (1-99):(99-1), preferably from (10-90):(90-10) and most preferably from (40-60):(60-40).

In the second embodiment, a reaction occurs between components (A) and (B). The reaction is brought about by utilizing a catalyst. Components (A) and (B) are esters and the reaction of these components is an interesterification that produces various products according to the following reaction:

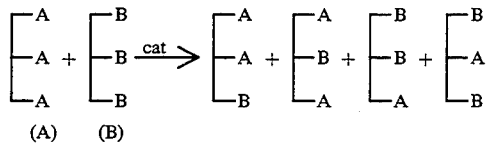

The catalyst is acidic, basic or enzymatic. The basic catalyst comprises alkali or alkaline earth metal alkoxides containing from 1 up to 6 carbon atoms. Preferred basic catalysts are sodium or potassium methoxide, calcium or magnesium methoxide, the ethoxides of sodium, potassium, calcium or magnesium and the isomeric propoxides of sodium, potassium, calcium or magnesium. The most preferred basic catalyst is sodium methoxide. The acidic catalyst comprises mineral acids or organic acids containing from 1 up to 6 carbon atoms. Preferred mineral acidic catalysts are hydrochloric acid, nitric acid, sulfuric acid and phosphoric acid. Preferred organic acid catalysts are formic acid, acetic acid, propionic acid, the isomers of butyric acid, valeric and caproic. The enzymatic catalyst comprises the lipases and esterases.

Within this embodiment wherein a reaction occurs between components (A) and (B), the weight ratio of (A):(B) is from (1-99):(99-1), preferably from (10-90):(90-10) and most preferably from (40-60):(60-40).

Example A-6

Added to a flask are 210 parts Sunyl 80 oil and 90 parts of the product of Example A-1. The contents are heated to 90° C. under 20 millimeters mercury. Sodium methoxide catalyst (1.3 parts) is slowly added and the vacuum reapplied. After 1.5 hours of reaction, 0.5 parts phosphoric acid is added to neutralize the catalyst. The contents are filtered to give the desired interesterified product.

In an even further embodiment, acids other than aliphatic monocarboxylic acids may be reacted with the hydroxy containing triglyceride to form an estolide. These may be aliphatic dicarboxylic acids or aryl mono-, di- or tri- carboxylic acids. Aliphatic dicarboxylic acids are of the formula HOOCCH=CHCOOH or $HOOC(CH_2)_tCOOH$ wherein t is from zero up to 8. Envisioned within the formula HOOCCH=CHCOOH are maleic acid and fumaric acid. The aliphatic dicarboxylic acids of interest are: oxalic acid, malonic acid, succinic acid, glutaric acid, adipic acid, pimelic acid, suberic acid, azelaic acid and sebacic acid. One —COOH of component (B) is employed for each —OH group present within component (A).

The aryl carboxylic acids are of the formula $Ar(COOH)_x$ wherein Ar is a benzene or naphthalene nucleus and x is 1, 2 or 3. Aryl carboxylic acids having utility in this invention are benzoic acid, phthalic acid, isophthalic acid, terephthalic acid, 1,2,3,-benzenetricarboxylic acid, 1,2,4-benzenetricarboxylic acid, 1,3,5-benzenetricarboxylic acid, and the various isomers of the mono-, di- and tri- naphthoic acids. Again one —COOH of component (B) is employed for each —OH group present within component (A).

As stated earlier, one way of shifting the equilibrium to the right is to employ excess carboxylic acid. After the estolide is formed the excess carboxylic acid can be distilled out or the carboxylic acid can be reacted with a basic compound to form a salt which is then separated out.

Examples of the formation of estolides utilizing aliphatic dicarboxylic acids or aryl mono-, di, or tri-carboxylic acids are as follows.

Example A-7

Added to a 2 liter, 4 neck flask are 457 parts lesquerella oil, 58 parts fumaric acid, 4 parts methanesulfonic acid and 250 parts xylene. The lesquerella oil and fumaric acid are charged on a 1 —OH:1 —COOH basis. Mixing is begun at room temperature and it is noted, that the fumaric acid remains insoluble. The contents are heated to effect solution. The temperature is increased to 150° C. and held for 16 hours during which time 9 ml of water is obtained. Solvent is removed first by nitrogen sweeping and finally under vacuum of 25 millimeters mercury. At 70° C. the contents are filtered to give the desired product.

Example A-8

Following the procedure of Example A-7, 457 parts lesquerella oil, 54.6 parts adipic acid, 5 parts para-toluenesulfonic acid and 400 parts xylene are reacted at 150° C. The contents are stripped and filtered to give the desired product.

Example A-9

The procedure of Example A-7 is repeated except that fumaric acid is replaced with maleic acid.

Example A-10

Following the procedure of Example A-7, 457 parts lesquerella oil, 94 parts azelaic acid, 8 parts para-toluenesulfonic acid and 500 parts xylene are reacted at 150° C. The contents are stripped and filtered to give the desired product.

Example A-11

Following the procedure of Example A-7, 457 parts lesquerella oil, 84 parts phthalic acid, 7 parts para-toluenesulfonic acid and 400 parts xylene are reacted at 150° C. The contents are stripped and filtered to give the desired product.

Example A-12

The procedure of Example A-11 is repeated except that phthalic acid is replaced with isophthalic acid.

Example A-13

The procedure of Example A-11 is repeated except that phthalic acid is replaced with terephthalic acid.

Example A-14

Following the procedure of Example A-7, 457 parts lesquerella oil, 105 parts hemimellitic acid, 10 parts para-toluenesulfonic acid and 500 parts xylene are reacted at 150° C. The contents are stripped and filtered to give the desired product.

Example A-15

The procedure of Example A-14 is repeated except that hemimellitic acid is replaced with trimellitic acid.

Example A-16

The procedure of Example A-14 is repeated except that hemimellitic acid is replaced with trimesic acid.

The below Table I outlines examples of this invention wherein components (A) and (B) are blended or reacted together according to the above ranges to effect solution. All parts are by weight.

TABLE I

| | THICKENING RESULTS OF VEGETABLE OILS MIXED OR REACTED WITH ESTOLIDES | | | |
|---|---|---|---|---|
| EXAMPLE | (A) ESTOLIDE | (B) VEGETABLE OIL | 40° C. VISCOSITY | 100° C. VISCOSITY |
| 1 | NONE | 100 PARTS SUNYL 80 | 39.76 Cst | 8.59 Cst |
| 2 | NONE | 100 PARTS RS80 | 36.96 | 8.29 |
| 3 | 10 PARTS PRODUCT OF EXAMPLE A-8 | 90 PARTS RS80 | 61.95 | 12.27 |
| 4 | 5 PARTS PRODUCT OF EXAMPLE A-7 | 95 PARTS SUNYL 80 | 49.09 | 10.35 |
| 5 | 20 PARTS PRODUCT OF EXAMPLE A-7 | 80 PARTS SUNYL 80 | 98.57 | 18.28 |
| 6 | 30 PARTS PRODUCT OF EXAMPLE A-7 | 70 PARTS SUNYL 80 | 141.87 | 24.72 |
| 7 | 5 PARTS PRODUCT OF EXAMPLE A-8 | 95 PARTS SUNYL 80 | 46.54 | 9.73 |
| 8 | 10 PARTS PRODUCT OF EXAMPLE A-8 | 90 PARTS SUNYL 80 | 64.62 | 12.98 |
| 9 | 20 PARTS PRODUCT OF EXAMPLE A-8 | 80 PARTS SUNYL 80 | 77.01 | 14.32 |
| 10 | 30 PARTS PRODUCT OF EXAMPLE A-8 | 70 PARTS SUNYL 80 | 107.66 | 18.51 |
| 11 | 5 PARTS PRODUCT OF EXAMPLE A-3 | 95 PARTS SUNYL 80 | 41.89 | 8.92 |
| 12 | 10 PARTS PRODUCT OF EXAMPLE A-3 | 90 PARTS SUNYL 80 | 44.53 | 9.31 |
| 13 | 20 PARTS PRODUCT OF EXAMPLE A-3 | 80 PARTS SUNYL 80 | 50.1 | 10.09 |
| 14 | 30 PARTS PRODUCT OF EXAMPLE A-3 | 70 PARTS SUNYL 80 | 56.25 | 10.91 |
| 15 | 30 PARTS PRODUCT OF EXAMPLE A-1 | 70 PARTS SUNYL 80 | 55.95 | 10.47 |
| 16[1] | 30 PARTS PRODUCT OF EXAMPLE A-1 | 70 PARTS SUNYL 80 | 50.67 | 10.11 |

[1]Reacted as per Example A-6

While the invention has been explained in relation to its preferred embodiments, it is to be understood that various modifications thereof will become apparent to those skilled in the art upon-reading the specification. Therefore, it is to be understood that the invention disclosed herein is intended to cover such modifications as fall within the scope of the appended claims.

What is claimed is:

1. A composition, comprising;

(A) at least one triglyceride estolide of the formula

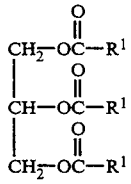

wherein $R^1$ is an aliphatic group or an aliphatic group containing an ester moiety $R^2COO$— with the proviso that at least one $R^1$ is an aliphatic group containing the ester moiety, and contains from about 5 to about 23 carbon atoms, and $R^2$ is a hydrocarbyl group containing from 1 to 100 carbon atoms and (B) at least one animal fat, vegetable oil or synthetic triglyceride oil of the formula

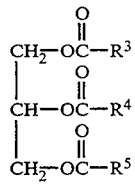

wherein $R^3$, $R^4$ and $R^5$ are aliphatic groups or hydroxy containing aliphatic groups that are at least 60 percent monounsaturated and further wherein an oleic acid moiety :linoleic acid moiety ratio is from about 2 up to about 90, and contain from about 1 to about 23 carbon atoms.

2. The composition of claim 1 wherein the triglyceride of (B) is a vegetable oil triglyceride.

3. The composition of claim 2 wherein $R^3$, $R^4$ and $R^5$ independently contain from about 5 to about 23 carbon atoms.

4. The composition of claim 1 wherein the vegetable oil triglyceride comprises sunflower oil, safflower oil, corn oil, soybean oil, rapeseed oil, meadowfoam oil, lesquerella oil, castor oil or genetically modified sunflower oil, safflower oil, corn oil, soybean oil, rapeseed oil, lesquerella oil or meadowfoam oil.

5. The composition of claim 2 wherein $R^3$, $R^4$ and $R^5$ independently contain from about 11 to about 21 carbon atoms.

6. The composition of claim 1 wherein the vegetable oil triglyceride has at least 70 percent monounsaturated character.

7. The composition of claim 1 wherein the monounsaturation of $R^3$, $R^4$ and $R^5$ is a residue of oleic acid.

8. The composition of claim 1 wherein one of the $R^1$ groups is an aliphatic group containing from 9 to 19 carbon atoms, the remaining $R^1$ groups are $$-(CH_2)_nCH{=}CHCH_2\underset{\underset{OCOR^2}{|}}{CH}(CH_2)_5CH_3,$$

$R^2$ is an aliphatic group containing from 1 to 23 carbon atoms and n is from 5 to 13.

9. The composition of claim 8 wherein $R^2$ is a heptadecenyl group.

10. The composition of claim 8 wherein $R^2$ is an isostearyl group.

11. The composition of claim 1 wherein $R^1$ is $$-(CH_2)_nCH{=}CHCH_2\underset{\underset{OCOR^2}{|}}{CH}(CH_2)_5CH_3,$$

$R^2$ is an aliphatic group containing from 3 to 17 carbon atoms and n is from 5 to 13.

12. The composition of claim 11 wherein $R^2$ is a heptadecenyl group.

13. The composition of claim 11 wherein $R^2$ is an isostearyl group.

14. The composition of claim 1 wherein (A) is an estolide of lesquerella oil or genetically modified lesquerella oil wherein $R^2$ is an alkyl group containing from 3 to 17 carbon atoms and (B) is a high oleic sunflower oil containing at least 75 percent oleic unsaturation.

15. The composition of claim 1 wherein the weight ratio of (A):(B) is from (1-99):(99-1).

16. The composition of claim 1 optionally utilizing (C) an acidic, basic or enzymatic catalyst.

17. The composition of claim 16 wherein the catalyst is an acidic catalyst.

18. The composition of claim 16 wherein the catalyst is a basic catalyst.

19. The composition of claim 16 wherein the catalyst is an enzymatic catalyst.

20. A composition, comprising;

(A) at least one triglyceride estolide prepared by reacting a triglyceride containing —OH functionality with a carboxylic acid of the formula $R^2COOH$, $HOOCCH{=}CHCOOH$, $HOOC(CH_2)_t$-COOH, or $Ar(COOH)_x$ or esters thereof wherein $R^2$ is a hydrocarbyl group containing from 1 to 100 carbon atoms, t is from zero up to 8, Ar is a benzene or naphthalene nucleus and x is 1, 2 or 3 and (B) at least one animal fat, vegetable oil or synthetic triglyceride oil of the formula

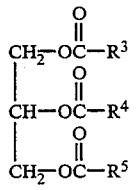

wherein $R^3$, $R^4$ and $R^5$ are aliphatic groups or hydroxy containing aliphatic groups that are at least 60 percent monosaturated and further wherein an oleic acid moiety:linoleic acid moiety ratio is from about 2 up to about 90 and contain from about 1 to about 23 carbon atoms.

21. The composition of claim 20 wherein t is from 2 to 8.

22. The composition of claim 20 wherein Ar is a benzene nucleus and x is 1.

23. The composition of claim 20 wherein $HOOCCH{=}CHCOOH$ is fumaric acid.

24. The composition of claim 20 wherein t is 4.

25. The composition of claim 20 wherein the triglyceride of (B) is a vegetable oil triglyceride.

26. The composition of claim 20 wherein $R^3$, $R^4$ and $R^5$ independently contain from about 11 to about 21 carbon atoms.

27. The composition of claim 20 wherein the vegetable oil triglyceride comprises sunflower oil, safflower oil, corn oil, soybean oil, rapeseed oil, meadowfoam oil, lesquerella oil, castor oil, or genetically modified sunflower oil, safflower oil, corn oil, soybean oil, rapeseed oil, lesquerella oil or meadowfoam oil.

28. A lubricant composition comprising from about 0.01 percent to about 30 percent by weight of the composition of claim 1.

29. A lubricant composition comprising from about 0.01 percent to about 30 percent by weight of the composition of claim 20.

* * * * *